United States Patent [19]

Rathert

[11] Patent Number: 4,801,036

[45] Date of Patent: Jan. 31, 1989

[54] COLLATING MACHINE WITH A DEVICE FOR PRE-ACCELERATING THE PRINTED SHEETS

[75] Inventor: Horst Rathert, Minden, Fed. Rep. of Germany

[73] Assignee: Kolbus GmbH & Co. KG, Rahden, Fed. Rep. of Germany

[21] Appl. No.: 148,484

[22] Filed: Jan. 26, 1988

[30] Foreign Application Priority Data

Jan. 29, 1987 [DE] Fed. Rep. of Germany ..... 3702608

[51] Int. Cl.[4] ..... B65H 39/02

[52] U.S. Cl. ..... 270/58; 270/54; 198/418.3

[58] Field of Search ..... 270/54, 58; 198/644, 198/717, 725, 728, 420, 421, 422, 732

[56] References Cited

U.S. PATENT DOCUMENTS 4,181,213 1/1980 Deutschlander ..... 198/442
4,511,132 4/1985 Müller ..... 270/58

FOREIGN PATENT DOCUMENTS 1486744 2/1966 Fed. Rep. of Germany .
2937611 5/1980 Fed. Rep. of Germany .
26759 2/1983 Japan ..... 270/54
398501 3/1966 Switzerland ..... 270/58

OTHER PUBLICATIONS

Research Disclosure, Castrignano et al, "Article Feeding/Combining Apparatus", May 1978, p. 52, No. 169.

*Primary Examiner*—Robert E. Garrett
*Assistant Examiner*—Therese M. Newholm
*Attorney, Agent, or Firm*—Chilton, Alix & Van Kirk

[57] ABSTRACT

A collating machine having a sweep element (6) for pre-accelerating the printed sheets (1) before they are acquired by the pusher dogs (5) of a collecting conveyor (2). The sweep elements (6) are connected to the pusher dogs (5), and are each able to be swung backwards and forwards in the transport direction. In addition, each element (6) is synchronized with the pusher-dog transport speed, via cam control means (8, 10), such that on approaching the printed sheet (1) which is resting on the supporting table (4) the element (6) swings backwards from an initial position (Position I) into which it has been swung forwards, comes into contact with the printed sheet (1), preferably at the moment when the speed of the backward swing is at a maximum (Position II), and is brought back to the pusher-dog transport speed during the further backward swing (Position III).

17 Claims, 2 Drawing Sheets

COLLATING MACHINE WITH A DEVICE FOR PRE-ACCELERATING THE PRINTED SHEETS

BACKGROUND OF THE INVENTION

The present invention relates to a sheet collating machine, and more particularly, to a printed sheet collating machine.

Such collating machines typically include a plurality of feed stations that are located in a row, a collecting conveyor that comprises a collecting channel and an endless conveying chain with pusher dogs which push the printed sheets on the collecting channel, supporting tables which are located between the feed stations and the collecting channel, from which the pusher doges sweep the individually separated printed sheets and transport them onwards, and a device for pre-accelerating the printed sheets before they are acquired by the pusher dogs.

In older-type collating machines, the printed sheets, once separated one from another in the individual feed stations and deposited onto the supporting tables, are accelerated from rest by the pusher dogs that are associated with the collecting conveyor, up to the transport speed of this conveyor. It is well known that this acceleration process is accompanied by a shock which causes distortion and buckling of the printed sheets, and gives rise to malfunctions once a certain speed is exceeded.

These problems occur when operating at high repetition rates, and to counter them, use is made of pre-accelerating devices to bring the printed sheets, once deposited on the supporting tables, up to an initial speed before they are acquired by the pusher dogs.

A known pre-accelerating device is described in published West German Patent Application DE-AS No. 14 86 744. With this device, the supporting tables are caused to reciprocate, all together, in the conveying direction. The printed sheets do not need to be accelerated from rest before being acquired by the pusher dogs of the conveyor, but instead need to be accelerated only from the forward speed of the supporting tables, up to the transport speed of the conveyor.

This pre-accelerating device requires comparatively elaborate constructional arrangements for generating the movement of the supporting tables and, moreover, it cannot be utilized for increasing output still further owing to the fact that heavy masses must be caused to reciprocate.

Furthermore, West German Patent Application DE-AS No. 29 37 611 discloses a device for accelerating printed sheets, wherein use is made of an accelerating means that is rotated by a drive, this accelerating means acting against the supporting table, acquiring the printed sheet lying thereon, and accelerating it in the conveying direction by frictional adhesion.

West German Patent Application DE-OS No. 31 26 808 discloses an arrangement wherein the accelerating means is of bar-shaped design and is set parallel to the supporting table. This design is adapted to prevent comparatively wide printed sheets from twisting, during the accelerating phase, at the moment that they are acquired by the pusher dogs.

The known accelerating devices briefly discussed above involve relatively elaborate and expensive constructional arrangements, and they cannot be utilized for all collating systems because of their bulkiness. Moreover, these accelerating devices require significant set-up time and readjustment to suit the thickness of the printed sheet is also rather time consuming. In addition, it is impossible to exclude the risk of marking the printed sheet while the accelerating means is exerting pressure on the supporting table.

SUMMARY OF THE INVENTION

The primary object of the present invention is to provide an apparatus and method for pre-accelerating the sheets in a sheet collating machine before they are acquired by the pusher dogs, while avoiding the disadvantages affecting known pre-accelerating devices. The present invention is characterized, in particular, by uncomplicated construction and high operational reliability.

The above-discussed and other objects are achieved by associated a sweep element with the transporting pusher dog, the sweep element being adapted to transfer a sheet fed to a stationary table onto a moving stack of sheets. The sweep element is actuated for rearward movement relative to the pusher dog during the initial contact of the sweep element with the sheet. This has the effect of reducing the shock experienced in the known arrangements when the pre-acceleration device initially contacts the sheet. The sweep element is subsequently brought to the same speed as the pusher dog as the sweep element causes the sheet to leave the table and be deposited on the stack. Thus, the sheet is moving at the same speed as the pusher dog and the stack as the sheet is deposited thereon.

In an apparatus embodiment of the invention, the sweep element is operatively connected to the pusher dog, and has a degree of freedom along the transport direction of the pusher dog. Means, preferably including a cam surface and associated follower roller, are provided for actuating the sweep element relative to the pusher dog as the pusher dog approaches the table on which the single sheets are fed from a sheet feed bin. Preferably, the sweep element includes an arm portion adapted to pass the table for sweeping a sheet from the table onto a stack, and a base portion connected to the pusher dog for swinging the arm portion back and forth along the transport direction of the pusher dog. The cam arrangement sychronizes the swinging of the arm portion with the dog means transport speed so that when the arm contacts the sheet, the arm is swinging backward relative to the pusher dog. As the pusher dog continues to move relative to the table, the arm portion returns to a stationary position relative to the pusher doge and thus acquires the transport speed of the pusher dog in the region where the sheet is deposited on the stack.

BRIEF DESCRIPTION OF THE DRAWINGS

The invention is explained in greater detail below by reference to the preferred embodiment as shown in the accompanying drawings, in which.

DESCRIPTION OF THE PREFERRED EMBODIMENT

Figure 1:
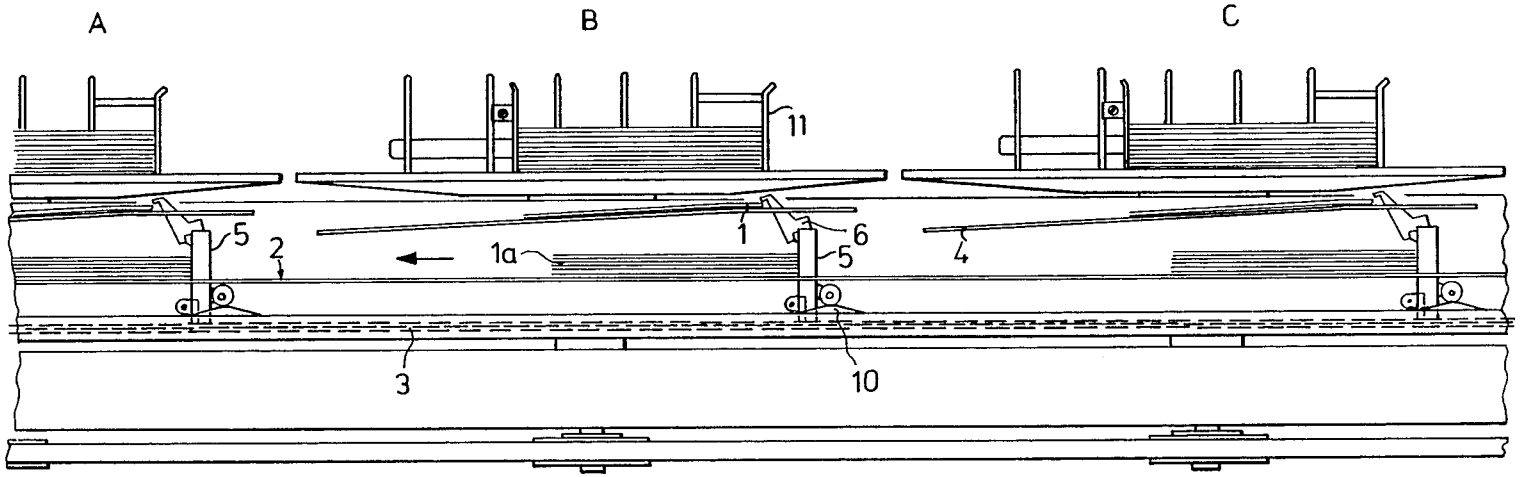
FIG. 1 shows a portion of a collating machine having the pre-accelerating elements according to the invention, installed on the pusher dogs.
Figure 2:
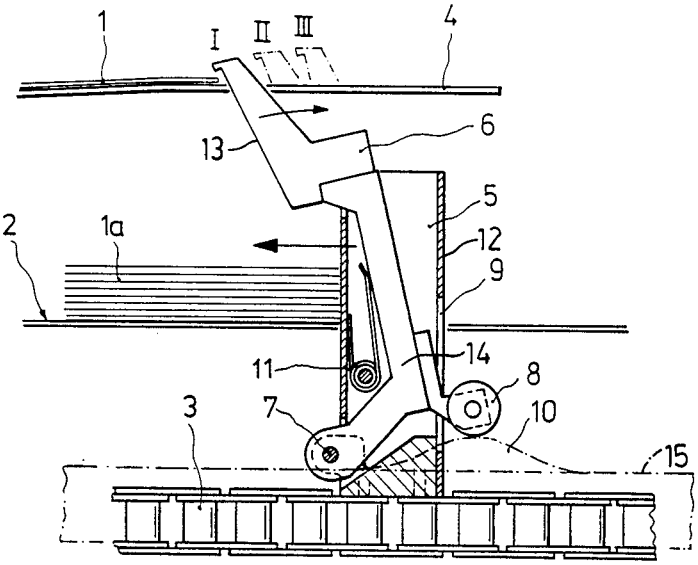
FIG. 2 shows an enlarged detail representation of a side view of a pusher dog with a pre-accelerating element.
Figure 3:
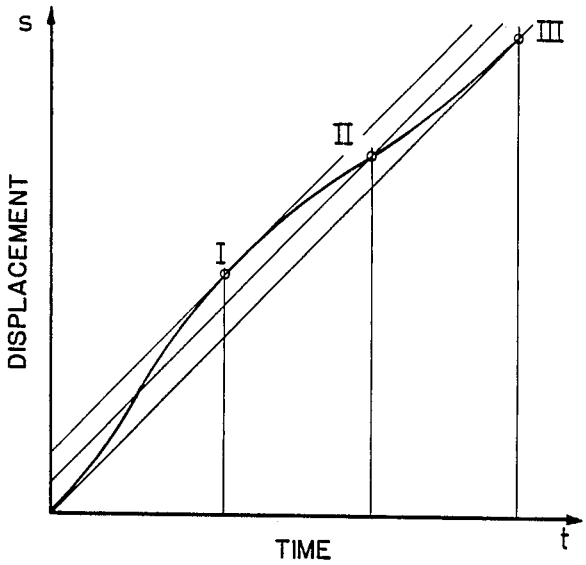
FIG. 3 shows a displacement-time diagram.

The description is keyed to FIGS. 1–3 and is based on a collating machine of the type which is described in U.S. Pat. No. 4,383,683. This machine has a plurality of sheet feed stations A, B, and C which are located in a row, and a collecting conveyor system that comprises a collecting channel 2 and an endless conveying chain 3. Chain 3 is provided with pusher dogs 5 which push the stack of collated printed sheets 1*a*, along a collecting channel 2. The channel 2 preferably is formed by a stationary support surface through which the pusher dogs 5 pass through a slot to transport the stacks on the surface. Stationary tables 4 are located between the bins 11 of the individual feed stations and the collecting channel 2 to serially receive individual sheets 1 from the bins. The printed sheets 1, separated one from another, are individually guided down from the tables 4, so as to be deposited onto a moving stack 1*a* of printed sheets.

The pusher dogs 5 each comprise a vertical, tubular body 12 which is carried horizontally under the tables by the conveying chain 3. Each pusher dog has a pre-accelerating element 6 for sweeping the printed sheets 1 from the supporting tables 4. The pre-acceleration or sweep elements 6 preferably include an arm portion 13 which are capable of being swung backwards and forwards in the pusher-dog transport direction. The element 6 also preferably has a base portion 14 located inside the pusher dog 5, such that it can rotate on a shaft 7 fixed with respect to the pusher dog. The elements 6 are each actuated by means of a cam path or track 10 via a cam follower roller 8 carried by the base portion 14 which projects through a cut-out 9 in the pusher dog 5.

Each follower roller 8 is kept in contact with the cam path 10 by means of spring element 11 between the inner wall of the pusher dog body 12 and the base portion 14 of the pre-accelerating element 6. The cam path 10 is supported by the chain guide 15 and is fixed with respect to the chain 3, but can be adjusted to suit the rest position of the printed sheet 1. In consequence of this, the pre-accelerating element 6 always strikes the printed sheet consistently, irrespective of pitch errors in the conveying chain 3. Preferably, the cam surface is bell-shaped and located immediately upstream of the sheet rest position on table 4.

With a view to ensuring that the printed sheets 1 are guided down the decline of the table 4 in a troublefree manner onto the stacks of sheets that lie in front of the pusher dogs 5, the pre-accelerating elements 6 preferably have a forwardly inclined setting relative to the vertical locating faces of the pusher dogs 5 that push against stacks 1*a*.

In the preferred embodiment, as illustrated graphically in FIG. 3, before the pre-accelerating element 6 strikes a printed sheet 1 that is resting on the supporting table 4, there first occurs a forward swing, onto the position I. On approaching the printed sheet 1, the pre-accelerating element 6 begins its backward swing. In the position II, where the speed of this backward swing reaches a maximum, and at which moment the impact speed against the sheet is consequently lowest, the pre-accelerating element 6 comes into contact with the edge of the printed sheet 1 which begins to be accelerated. The speed of element 6 when it contacts the sheet is preferably less than one-half the pusher dog transport speed. The element 6 continues to yield, with the printed sheet 1, as far as the position III, where the element establishes a constant position relative to the pusher-dog. Thus, the element 6 regains the speed of the pusher dog 5 and the printed sheet 1 has been accelerated to the speed of the pusher dog 5 without having been subjected to any shock. The printed sheet 1 is now swept from the supporting table 4, and deposited onto the stack 1*a* of printed sheets that have been transported forward by the pusher dog 5.

While a preferred embodiment has been shown and described, various modifications and substitutions may be made thereto without departing from the spirit and scope of the invention. Accordingly, it is to be understood that the present invention has been described by way of illustration and not limitation.

I claim:

1. A collating machine comprising:

a plurality of feed stations located in a row, each feed station including a feed sheet bin;

a stationary support table situated below each of the feed sheet bins, for serially receiving single sheets from the feed sheet bin for transfer to a stack of sheets;

a channel situated below the tables, the channel including a support surface for receiving individual sheets from the tables in a plurality of collated stacks;

a conveyor including dog means associated with each stack for transporting the stacks on the channel support surface;

pre-acceleration means for sweeping an individual sheet from a support table with sufficient acceleration in the transport direction to deposit the sheet on a stack as the stack is transported by the dog means along the channel, said pre-acceleration means including, a sweep element associated with each dog means and movable therewith through the channel, the sweep element having an arm portion adapted to pass the table for sweeping a sheet from the table onto a stack, and a base portion connected to one of the dog means for swinging the arm portion back and forth along the transport direction of the dog means;

means for synchronizing the swinging of the arm portion with the dog means transport speed, such that when approaching a sheet on the table, the arm portion is angled forward toward the sheet, when contact is made with the sheet the arm portion is swinging backward relative to the dog means, and the arm portion is moving at the speed of the dog means when the sheet is deposited on the stack.

2. The collating machine of claim 1, wherein the means for synchronizing the swinging of the arm portion includes cam means for imparting the forward and backward motion of the swinging arm relative to the dog means.

3. The collating machine of claim 2, wherein the cam means includes a follower roller on the bottom portion of the sweep element.

4. The collating machine of claim 1, wherein the arm portion is synchronized such that the arm portion initiates contact with the sheet on the table at the moment when the backward speed of the arm portion relative to the dog means is at its maximum.

5. The collating machine of claim 2, wherein the dog means is hollow and the sweep element is pivotally mounted inside the dog means, the cam means includes a cam path and a follower roller on the base portion of the sweep element, and means are provided for biasing the follower roller into contact with the cam means during the back and forth movement of the arm portion relative to the pusher dog.

6. The collating machine of claim 1, wherein the dog means has a vertical face for pushing the stack along the support surface, and the arm portion of the sweep element is at a forward incline relative to said vertical face during the sweeping of the sheet.

7. The collating machine of claim 2, wherein the dog means has a vertical face for pushing the stack along the support surface, and the arm portion of the sweep element is at a forward incline relative to said vertical face during the sweeping of the sheet.

8. The collating machine of claim 5, wherein the dog means has a vertical face for pushing the stack along the support surface, and the arm portion of the sweep element is at a forward incline relative to said vertical face during the sweeping of the sheet.

9. Apparatus for sweeping a printed sheet forward and downward from a first position on an inclined table to a second position on a moving stack of sheets below the table, comprising:

a substantially vertically extending pusher dog;

means for displacing the pusher dog horizontally to transport the stack of sheets;

a sweep element operatively connected to the pusher dog, for sweeping a sheet from the support table onto the stack of sheets, the sweep element having a degree of freedom along the transport direction of the pusher dog; and means for actuating the sweep element to produce rearward movement of the sweep element relative to the pusher dog during initial contact of the sweep element with the sheet, and for maintaining the forward speed of the sweep element the same as that of the pusher dog when the sweep element deposits the sheet on the stack of sheets.

10. The apparatus of claim 9, wherein the pusher dog is hollow and the sweep element is mounted for pivotal movement inside the pusher dog.

11. The apparatus of claim 9, wherein the sweep element includes an arm portion for contacting the sheet on the table, and a base portion mounted for pivotal movement in the pusher dog, the base portion including a follower roller, said arrangement further including cam means defining a cam path traveled by the follower roller for imparting the required motion of the sweep element relative to the pusher dog.

12. The apparatus of claim 11, further including means located within the pusher dog, for biasing the follower roller against said cam path.

13. The apparatus of claim 11, wherein the arm portion of the sweep element is at a forward incline relative to the vertical pusher dog.

14. In a collating machine of the type having a plurality of feed stations located in a row, each feed station including a feed sheet bin, a stationary table situated below each of the feed sheet bins for serially receiving single sheets from the feed sheet bin for transfer to a stack of sheets, a channel situated below the tables and including a surface for supporting the stacks of sheets, a conveyor system including dog means for pushing the supported stacks along a transport direction, a method for pre-accelerating the single sheets on the table and depositing them on the moving stacks, comprising:

moving the dog means in a forward direction in the channel;

transporting a sweep element with the dog means in the channel to transfer a single sheet from the table to a stack;

actuating the sweep element for rearward movement relative to the dog means during the initial contact of the sweep element with the sheet; and maintaining the sweep element stationary relative to the dog means as the sheet leaves the table and is deposited on the stack.

15. The method of claim 14, wherein the step of actuating the sweep element includes pivoting the sweep element forward and backward about a point fixed with respect to the pusher dog.

16. The method of claim 14, wherein the step of actuating the sweep element includes the step of rolling a portion of the sweep element along a stationary cam surface.

17. The method of claim 16, including the further step of adjusting the stationary cam surface commensurate with the position of the sheet on the table.

* * * * *